US011407247B2

(12) United States Patent
Monzo et al.

(10) Patent No.: US 11,407,247 B2
(45) Date of Patent: Aug. 9, 2022

(54) CRAYON STORING AND DISPENSING DEVICE

(71) Applicant: CRAYOLA LLC, Easton, PA (US)

(72) Inventors: Anthony P. Monzo, Easton, PA (US); James Allen, Easton, PA (US); Douglas Brand, Easton, PA (US)

(73) Assignee: Crayola LLC., Easton, PA (US)

( * ) Notice: Subject to any disclaimer, the term of this patent is extended or adjusted under 35 U.S.C. 154(b) by 0 days.

(21) Appl. No.: 17/193,365

(22) Filed: Mar. 5, 2021

(65) Prior Publication Data

US 2021/0283942 A1 Sep. 16, 2021

Related U.S. Application Data

(60) Provisional application No. 62/988,682, filed on Mar. 12, 2020.

(51) Int. Cl.
*B43K 23/016* (2006.01)
*B43K 29/06* (2006.01)

(52) U.S. Cl.
CPC ..... *B43K 23/016* (2013.01); *B43K 29/06* (2013.01)

(58) Field of Classification Search
CPC ..... A47F 3/085; A47F 5/03; A47F 5/0037; A47F 7/0021; A47F 7/0028; A47F 7/0035; B43K 23/016; B43K 23/06; B43K 29/06; B43K 29/18; B43K 31/00; A47B 49/002; B25H 3/025; B43M 99/006; B43M 99/008
USPC ..... 211/69.5–69.9, 70
See application file for complete search history.

(56) References Cited

U.S. PATENT DOCUMENTS 846,133 A * 3/1907 McIntyre ..... A47F 5/112 211/69.9
4,538,736 A * 9/1985 Berger ..... A47F 7/0028 211/168
5,163,549 A * 11/1992 Hayduchok ..... A45C 11/34 206/214
8,955,699 B2 * 2/2015 Wilder ..... B25H 3/025 211/77
2008/0190788 A1 * 8/2008 Cziraky ..... B43M 99/00 206/214

FOREIGN PATENT DOCUMENTS

FR 2605297 A1 * 4/1988 ..... B43M 99/001

* cited by examiner

*Primary Examiner* — David P Angwin
*Assistant Examiner* — Bradley S Oliver
(74) *Attorney, Agent, or Firm* — Shook, Hardy & Bacon L.L.P.

(57) ABSTRACT

Devices and kits for organizing, storing, and dispensing crayons are described herein. The crayon storing and dispensing device(s) described herein allow a user to access a crayon located at any retaining/dispensing holder by rotation of one or more components of the crayon storing and dispensing device(s). In accordance to aspects herein, the retaining/dispensing holders of the crayon storing and dispensing device(s) are arranged in one or more concentric rows of retaining/dispensing holders such that rotation of the crayon storing and dispensing device gives access to different crayons located at different positions.

20 Claims, 7 Drawing Sheets

CRAYON STORING AND DISPENSING DEVICE

CROSS-REFERENCE TO RELATED PATENT APPLICATIONS

This is a Non-provisional Patent Application claiming priority to U.S. Provisional Application No. 62/988,682, filed on Mar. 12, 2020, and entitled "Crayon Storing and Dispensing Device," the entirety of which is incorporated by reference herein.

TECHNICAL FIELD

The present disclosure relates to a crayon storing and dispensing device.

SUMMARY

This summary is intended to introduce a selection of concepts in a simplified form that are further described below in the detailed description section of this disclosure. This summary is not intended to identify key or essential features of the claimed subject matter, nor is it intended to be used as an aid in determining the scope of the claimed subject matter.

In brief, this disclosure describes, among other things, a crayon organizer device that provides easy access to a plurality of crayons being organized and stored in the crayon storing and dispensing device.

In one embodiment, a crayon storing and dispensing device is disclosed. The crayon storing and dispensing device comprises a first stand and a second stand configured to support a rotatable drum that is held a first distance above a supporting surface of the rotatable drum. The crayon storing and dispensing device further comprises a plurality of guide channels distributed around a curved surface of the rotatable drum. Each of the guide channels further comprises a plurality of retaining/dispensing holders configured to hold and dispense a crayon.

In another embodiment of the present disclosure, a crayon storing and dispensing device kit is disclosed. The crayon storing and dispensing device kit may comprise a crayon storing and dispensing device, a cleaning tool, and a plurality of crayons. The crayon storing and dispensing device may comprise a first stand and a second stand configured to support a rotatable drum a first distance above a supporting surface of a rotatable drum. The rotatable drum may further comprise a plurality of guide channels distributed around a curved surface of the rotatable drum and having a plurality of retaining/dispensing holders. Each of the retaining/dispensing holders in the plurality of retaining/dispensing holders of the crayon storing and dispensing device is configured to hold and dispense a crayon.

In another embodiment, a crayon storing and dispensing device is disclosed. The crayon storing and dispensing device comprises a central axis of rotation. The central axis of rotation is parallel to a plurality of guide channels that are arranged around a curved surface of a cylindrical rotatable drum. The cylindrical rotatable drum is supported a threshold distance above a supporting surface by a first stand and a second stand. The cylindrical rotatable drum comprises a first base and a second base, wherein a length of the cylindrical rotatable drum extends from the first base to the second base. In accordance with aspects herein, each of the guide channels in the plurality of guide channels comprises one or more retaining/dispensing holders configured to hold and dispense a crayon.

Additional objects, advantages, and novel features are further described in the detailed description, and in part, will become apparent to those skilled in the art upon examination of this disclosure, or may be learned through practice of the various embodiments of this disclosure.

BRIEF DESCRIPTION OF THE DRAWINGS

The present technology is described in detail below with reference to the attached drawing figures, wherein.

DETAILED DESCRIPTION

The subject matter of the present disclosure is described with specificity herein to meet statutory requirements. However, the description is not intended to limit the scope of the technology. Rather, the claimed subject matter may be embodied in other ways, such as to include different steps, combinations of steps, features, or combinations of features, similar to the ones described in this disclosure, and in conjunction with other present or future technologies. Moreover, although the term "step" may be used to identify different elements of methods employed, the term should not be interpreted as implying any particular order among or between various steps unless and except when the order of individual steps is explicitly described and required.

Figure 2A:
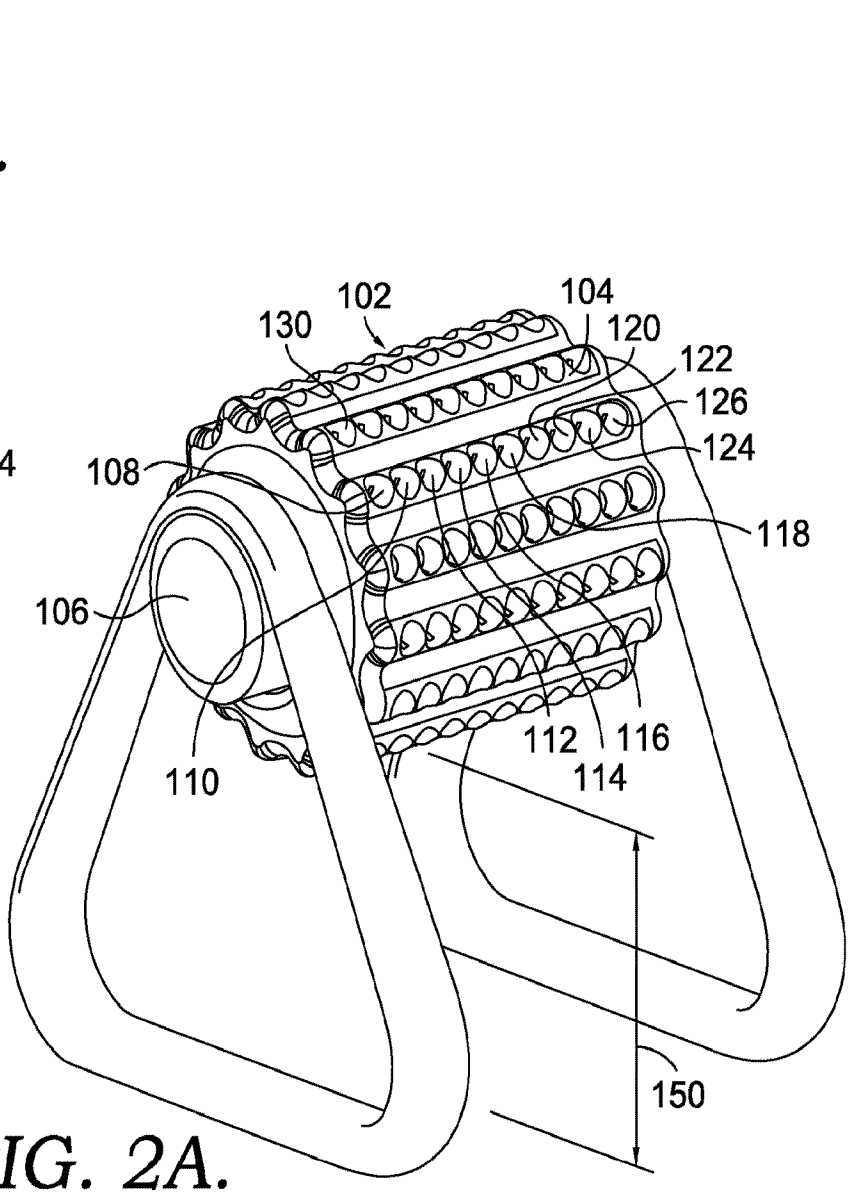
FIG. 2A depicts the crayon organizer and dispensing device of FIG. 1 in an unloaded state.
Figure 1:
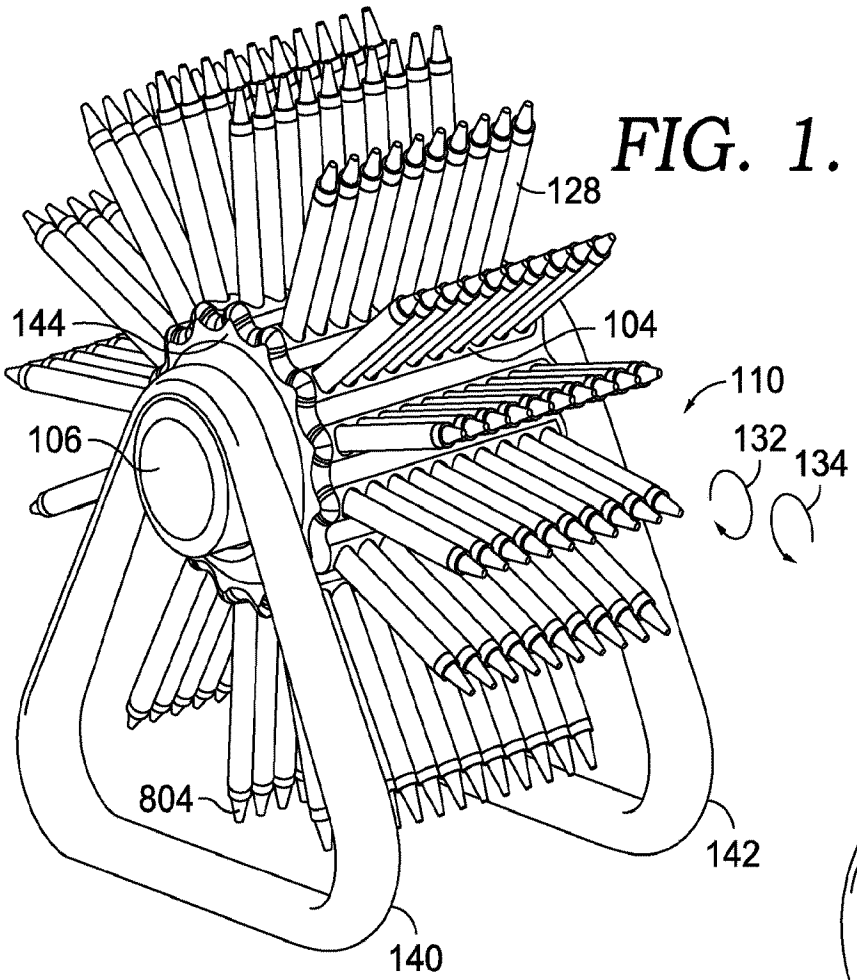
FIG. 1 depicts an exemplary loaded crayon organizer and dispensing device, in accordance with aspects herein.
Figure 2B:
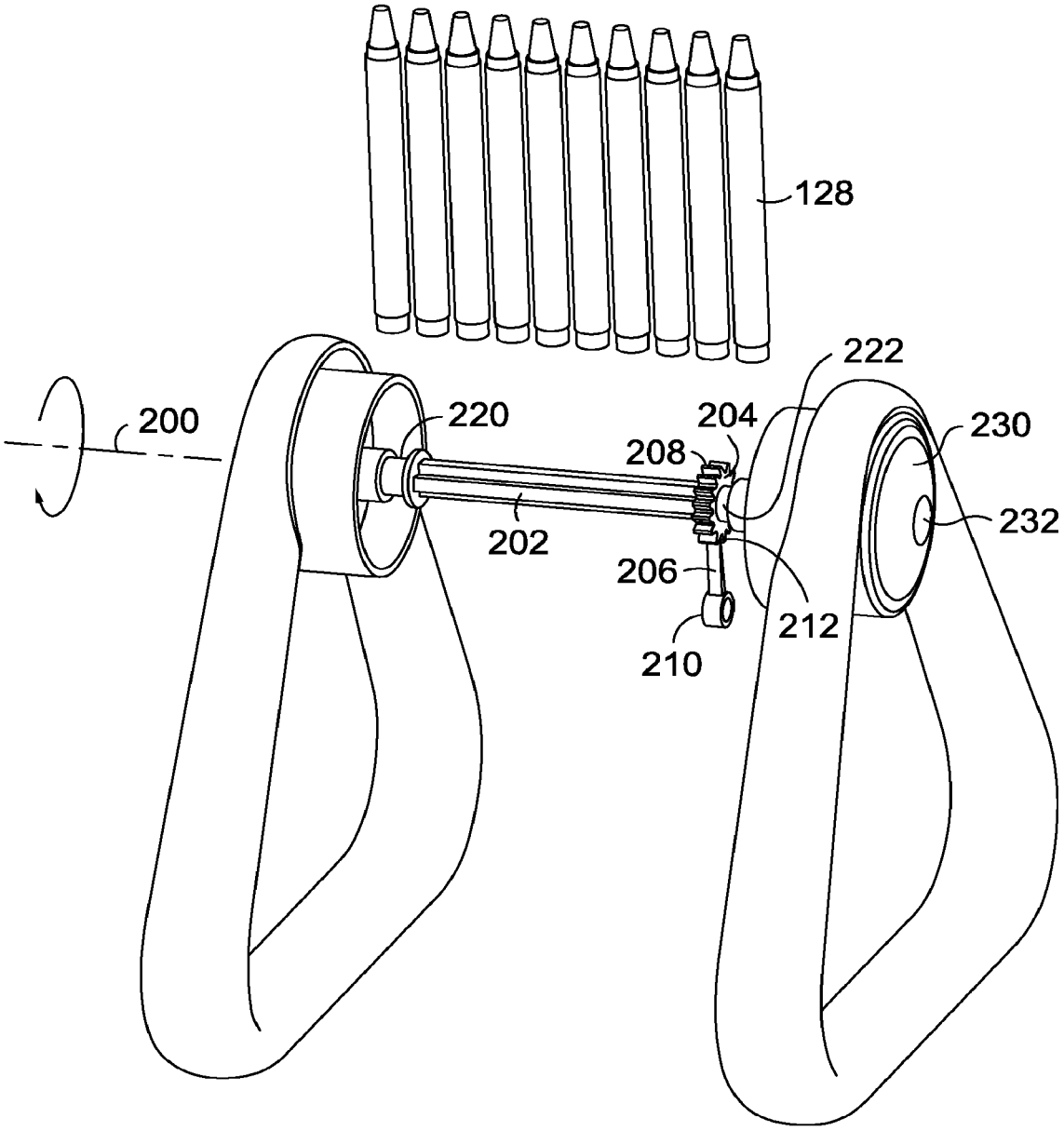
FIG. 2B depicts an internal view of the crayon organizer and dispensing device shown in FIG. 2A.
Figure 4:
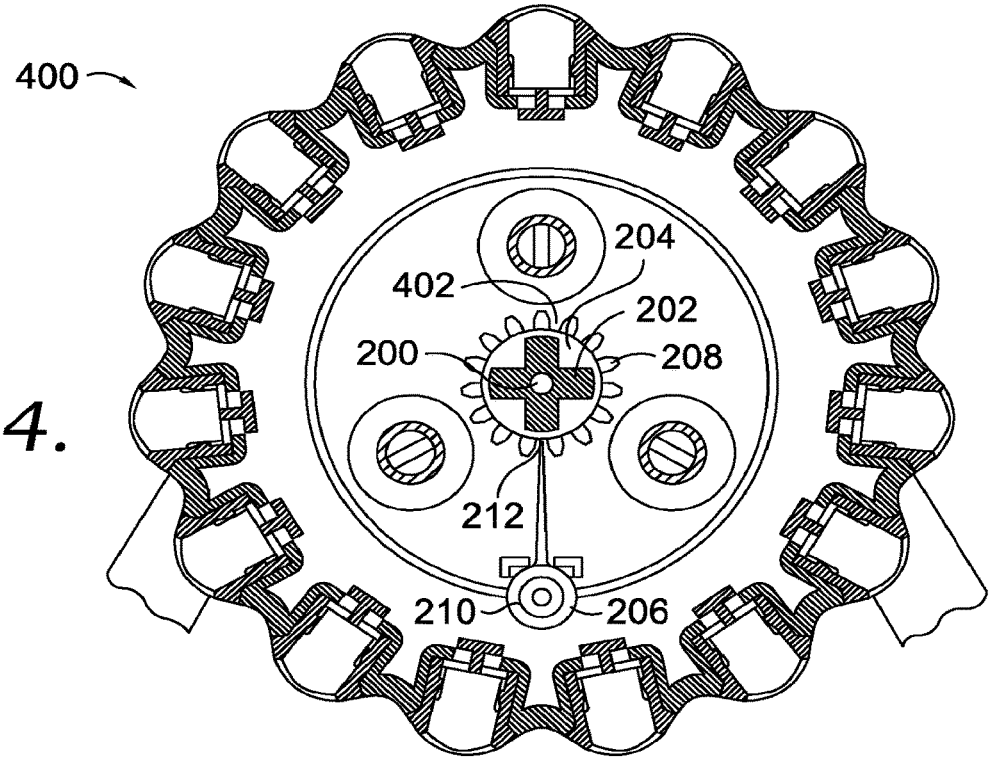
FIG. 4 depicts a cross-sectional view of the crayon organizer and dispensing device shown in FIG. 3, taken along the line 4-4 in FIG. 3.

At a high level, embodiments of the present technology relate to a crayon storage and dispensing device. Referring now to FIG. 1, a device 100 holding a plurality of crayons 128 is shown. The device 100 comprises, in part, a cylindrically shaped drum 102 comprising a plurality of guide channels 104 arranged parallel to a pole 202 located along a rotational axis 200 (as shown in FIGS. 2A and 2B) along the curved surface area of the cylindrically shaped drum 102. The plurality of guide channels 104 are evenly spaced apart and distributed along the curved surface area. As further shown, if FIG. 2A, each guide channels 104 may comprise a plurality of retaining/dispensing holders 130, each retaining/dispensing holder 130 may be configured to hold and retain a crayon 128. Together, the plurality of guide channels 104 in turn result in the plurality of retaining/dispensing holders 130 being arranged in a plurality of concentric rows 108, 110, 112, 114, 116, 120, 122, 124, and 126, for example, as shown in FIG. 2A and FIG. 4. When the crayon(s) 128 are placed in the retaining/dispensing holder(s) 130, the crayon(s) 128 stand orthogonal to the pole 202, as shown in FIG. 2B and FIG. 1. Although shown as having nine concentric rows 108, 110, 112, 114, 116, 120, 122, 124, and 126, it is contemplated that the device 100 may have "n" number of concentric rows, where "n" stands for any number that is greater than zero. For example, the device may have 1 row, 5 rows, 50 rows, 100 rows, and the like, depending on the application desired for the device. Additionally, it is contemplated that the circumference or curved surface area of the cylindrically shaped drum may also be increased or decreased to accommodate more or less guide channels 104. Also, it is contemplated that the circumference or curved surface area of the cylindrically shaped drum may be proportionately increased or decreased depending on a width associated with each of the guide channels 104, depending on their configuration to hold, for example, crayons or other similar elements having different sizes and/or shapes (i.e., differently sized and shaped cross-sectional areas).

The device 100 is configured to rotate around the rotational axis 200 in a first direction 132 or a second direction 134, which translate into a clockwise or counterclockwise direction. The first direction 132 and the second direction 134 are perpendicular to the rotational axis 200. When the cylindrically shaped drum 102 is rotated in the first direction or the second direction, the retaining/dispensing holder(s) 130 in each guide channel 104 relocate from a first position to a second position along the curved surface area of the cylindrically shaped drum 102, thereby giving the user easy access to crayon(s) 128 located at any of the retaining/dispensing holder(s) 130. In other words, for example, you can put a first crayon in one position at 12:00, a second crayon in another position at 3:00, and a third crayon in another position at 6:00, and when the second crayon in the 3:00 is facing a user, the user can easily access the second crayon at the 3:00 position by pulling it out toward him/her. When the cylindrically shaped drum 102 is spun, for example, in a clockwise direction, the first crayon may be moved to, for example, the 3:00 position, the second crayon to the 6:00 position, and the third crayon to the 9:00 position. In a counterclockwise direction, the first crayon may be moved to, for example, the 9:00 position, the second crayon may be moved to the 12:00 position, and the third crayon may be moved to the 3:00 position. As such, the device 100 allows the user to have continual access to select a crayon from one or more guide channel(s) 104 and concentric rows 108/110/112/114/116/118/120/122/124/126 of retaining/dispensing holder(s) 130 by virtue of rotating the cylindrically shaped drum 102 around the rotational axis 200 (as shown in FIG. 2B).

As shown in FIG. 2B, the rotational ability of the cylindrically shaped drum 102 may be propelled to rotate by the user to initiate rotation of the cylindrically shaped drum 102 and stopped by the user when the desired crayon is in a location that is accessible to the user. Alternatively, once the cylindrically shaped drum 102 is propelled, the cylindrically shaped drum 102 may be slowed down or alternatively stopped by a stopping pin 206 and gear 204 combination. For example, the gear 204 may comprise a plurality of teeth 208, and the stopping pin 206 may have a proximal end 210 where the stopping pin 206 is secured to an interior portion of the cylindrically shaped drum 102 of the device 100, and a distal end 212 configured to engage the plurality of teeth 208 such that every time the distal end 212 engages at least a portion of the plurality of teeth 208, the rotational momentum of the cylindrically shaped drum 102 is slowed down until it comes to a stop. Additionally, as the distal end 212 engages the portion of the plurality of teeth 208, a "clicking" sound may be emitted proportional to the rotational speed such as to audibly indicate to the user when the cylindrically shaped drum 102 slows down and ultimately comes to a stop. In other words, the number of "click" sounds emitted may gradually decrease from an initial number, as the cylindrically shaped drum 102 comes to a stop, at which point, no "click" sounds or zero clicks would be audible.

Figure 3:
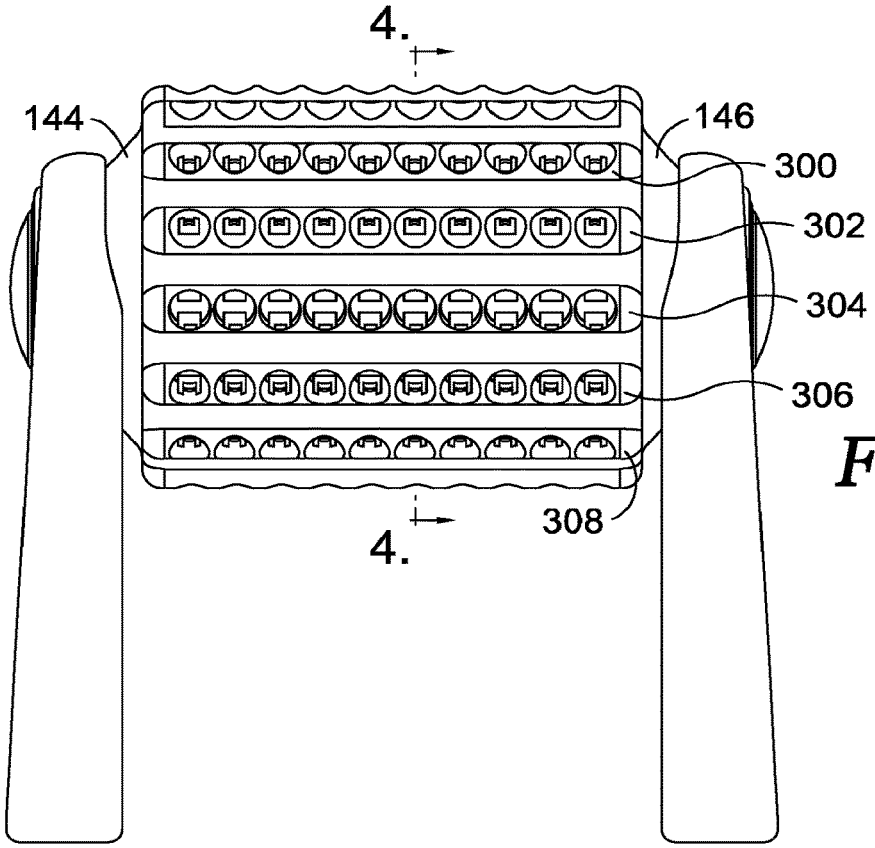
FIG. 3 depicts a side view of the crayon organizer and dispensing device shown in FIG. 2A.

Moving on to FIG. 3, a side view of the device 100 is shown, where an interior of each of the retaining/dispensing holders 130 can be viewed from different guide channels 104 placed along different portions of the curved surface area of the cylindrically shaped drum 102. For example, guide channel 300 shows a first angled view, guide channel 302 shows a second angled view, guide channel 304 shows a third angled view, guide channel 306 shows a fourth angled view, and guide channel 308 shows a fifth angled view of an interior of each of the retaining/dispensing holder(s) 130.

FIG. 4 is a cross-sectional view 400 of the cylindrically shaped drum 102 along the line 4-4 in FIG. 3 that cuts through concentric row 310. As shown, the pole 202 is at the center of the cylindrically shaped drum 102 and extends through the rotational axis 200 (as shown in FIG. 2B), which is located at the center of the cylindrically shaped drum 102. As further shown in FIG. 2B, the gear 204 is located proximal to a first end of the pole 202 and as shown in FIG. 4, the pole 202 extends through a central portion of the gear 204. Although the gear 204 and the pole 202 are shown as two separate pieces, it is contemplated that these may be formed as a single piece. As shown, the cross-sectional profile of the pole 202, in the present example, is shaped like a cross. This non-circular cross-sectional profile is configured to ensure that the gear 204 is immobilized with respect to the pole 202. Further, although shown as having a cross shape, it is contemplated that any non-circular cross-sectional profile of the pole 202 will work to immobilize the gear 204 with respect to the pole 202, without departing from aspects in accordance herein.

As further shown in FIG. 2B and FIG. 4, the stopping pin 206 is aligned with the gear 204 such that the distal end 212 of the stopping pin 206 is made to interact with the plurality of teeth 208 of the gear 204. The stopping pin 206 serves as a stopper for holding a certain position of the cylindrically shaped drum 102, and for slowing down the rotation of the cylindrically shaped drum 102 when a rotational force above a threshold amount is applied by a user of the device 100.

As shown, rotation of the cylindrically shaped drum 102 is stopped when the distal end 212 of the stopping pin 206 is lodged in a groove 402 that is between each pair of adjacent teeth in the plurality of teeth 208 of the gear 204.

In accordance with aspects herein, the distal end 212 of the stopping pin 206 comprises a degree of bendability that allows the distal end 212 to bend in a direction that is opposite to the rotational direction of the cylindrically shaped drum 102, when a force is applied by the user of the device 100. At the same time, the distal end 212 of the stopping pin 206 also comprises a degree of stiffness that allows it to return to its original upright posture when the force is absent or is weaker than a threshold amount of force needed to initiate rotation of the cylindrically shaped drum 102.

As shown in FIG. 4, the proximal end 210 of the stopping pin 206 may be affixed to an interior portion of the cylindrically shaped drum 102 such that the stopping pin 206 is relocated from a first position to a second position in a clockwise or counterclockwise direction with rotation of the cylindrically shaped drum 102, while the pole 202 and the gear 204 remain stationary, as shown. However, it is also contemplated that the gear 204 could be made to rotate, while making the stopping pin 206 stationary, without departing from aspects herein.

As further shown in FIG. 2B, the pole 202 comprises a first end portion 220 and a second end portion 222 having a circular cross-section for supporting the cylindrically shaped drum 102 to allow it to rotate about the pole 202. Additionally, the device 100 may comprise a first leg stand 140 and a second leg stand 142 for supporting the cylindrically shaped drum 102 a threshold distance 150 above a support surface 152 (as shown in FIG. 2A) on which the device 100 is placed to stand. As shown in FIGS. 1-2B, the first leg stand 140 is configured to support the first base 144 of the cylindrically shaped drum 102, and the second leg stand 142 is configured to support the second base 146 of the cylindrically shaped drum 102. In accordance with aspects herein, the threshold distance 150 is greater than a length of a crayon. For example, the threshold distance 150 may be 1% greater than the length of the crayon, 5% greater than the length of the crayon, 10% greater than the length of the crayon, and the like. For instance, if a crayon is 10 cm long, the threshold distance 150 may be 11 cm so that it is 10% greater than the length of the crayon. The threshold distance 150 allows for the cylindrically shaped drum 102 to freely rotate when it is loaded with one or more crayons and so that the crayon(s) are held above the support surface 152 and are prevented from touching it (as shown in FIG. 1). As further shown in FIG. 2B, the parts of the device 100 may also be secured by a pair of cap portions 106 on each leg. These cap portions 106 may be simple caps (as shown in FIGS. 1 and 2A), or may include additional features such as, for example, a crayon sharpener, a crayon label peeler, and the like, without departing from aspects herein, such as the cap 230 shown in FIG. 2B, with a crayon sharpener 232. Also, it is contemplated that one of the cap portions 106 may be a simple cap (as shown in FIGS. 1 and 2A), and the other cap portion 106, may include the added feature, as described above, or both of the caps may include an added feature, which may be the same on both, or different on each.

Figure 5:
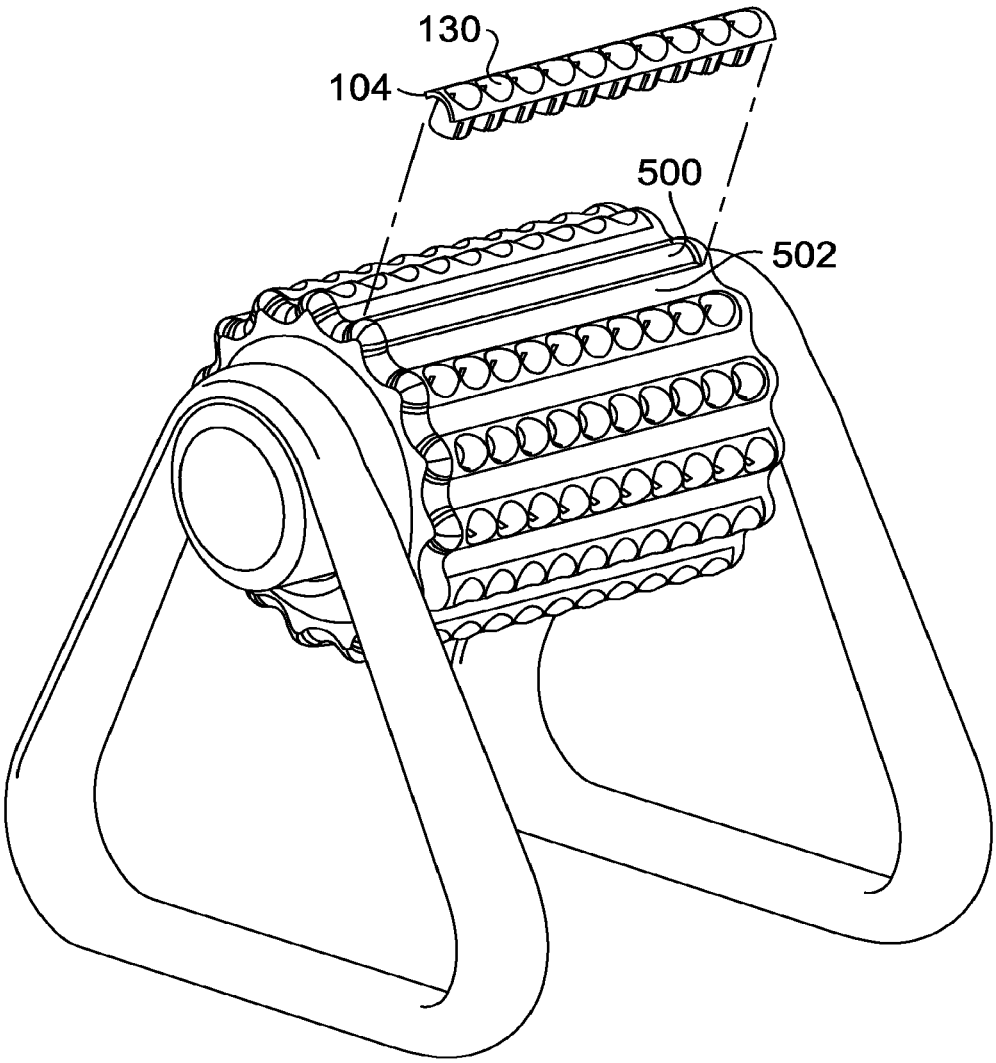
FIG. 5 depicts a removable feature of the crayon organizer and dispensing device, in accordance with aspects herein.

Moving on to FIG. 5, it can be seen that each guide channel 104 having the plurality of retaining/dispensing holders 130, may be removable features that can be fitted into a plurality of openings 500 evenly distributed around a curved face 502 of the cylindrically shaped drum 102 for, for example, cleaning the retaining/dispensing holders 130 from debris, crayon shavings, broken crayon pieces, and the like, which may accumulate in the retaining/dispensing holders 130 with repeated use.

Figure 6:
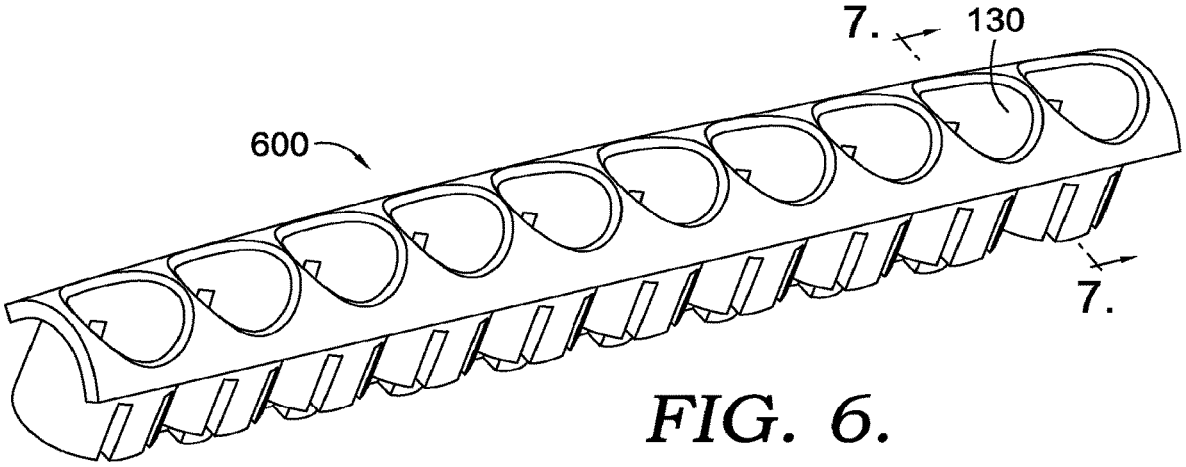
FIG. 6 depicts an exemplary guide channel used in the crayon organizer and dispensing device, in accordance with aspects herein.

As shown in FIG. 6, the guide channels 104, for example, as shown in guide channel 600, may comprise a plurality of individually separated retaining/dispensing holders 130. As shown in FIGS. 1 and 2A, each of the retaining/dispensing holders, in addition to being arranged parallel to the pole 202 (shown in FIG. 2B), are also arranged in concentric rows around the curved surface of the cylindrically shaped drum 102 (as shown in FIG. 2A). The retaining/dispensing holders 130 are evenly spaced apart to allow separation between stored crayons, once the device 100 is loaded with at least two crayons, or loaded to capacity. The separation may be advantageous for a user to be able to spot a desired crayon easily, and also be able to get the crayon from the device 100 without disturbing any of the other neighboring crayons.

Figure 7:
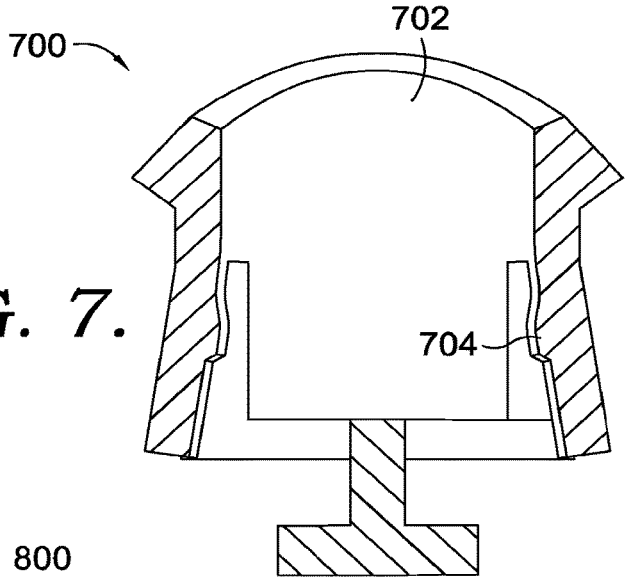
FIG. 7 depicts a cross-sectional view of the guide channel depicted in FIG. 6 taken along the line 7-7 in an unloaded state, in accordance with aspects herein.
Figure 8:
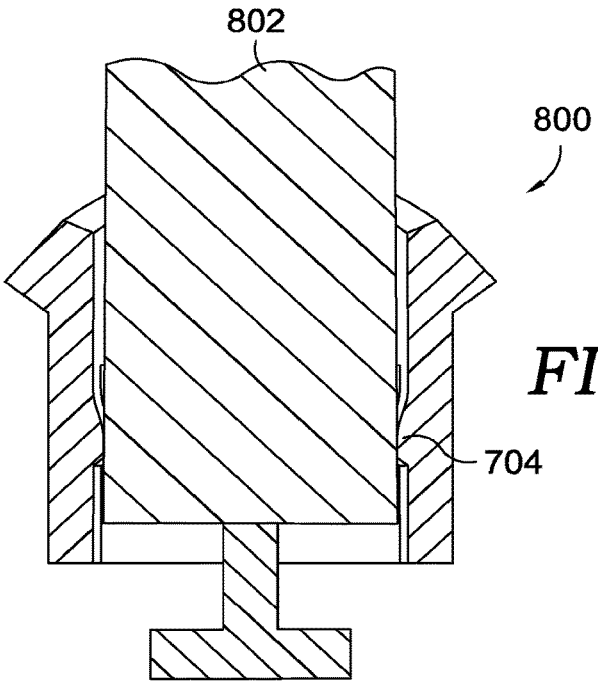
FIG. 8 depicts the cross-sectional view of the guide channel depicted in FIG. 7 in a loaded state.

Moving on to FIG. 7, a cross-sectional view 700 taken along the line labeled as 7-7 in FIG. 6 of a retaining/dispensing holder 130 is shown. As shown in FIG. 7, the interior cavity 702 of the retaining/dispensing holder 130 comprises two or more tab portions 704 inside the interior cavity 702 that are configured to retain a crayon 802 in the interior cavity 702 of the retaining/dispensing holder 130 until a user pulls the crayon 802 out, as can be seen in the cross-sectional view 800 in FIG. 8. In accordance with certain aspects herein, the tab portions 704 are slightly angled inward, which provides some resistance. When crayon 802 is pushed into the interior cavity 702, the tab portions 704 are flexed outwardly by the crayon's body that is within the interior cavity 702. The resistance provided by the natural state (angled inward) of the two or more tab portions 704 translates into a retaining force that is strong enough to allow the two or more tab portions 704 to hold onto the crayon 802, thereby defying gravity, even when the crayons 802 were to face straight down, such as, for example, crayon 804 shown in FIG. 1, and while the crayons are subjected to rotation when loaded onto device 100. However, the retaining force provided by the natural state (angled inward) of the two or more tab portions 704 is weak enough to allow a user to effortlessly remove each of the plurality of crayons 128 from the retaining/dispensing holders 130, as shown in FIG. 1. Although the mechanism for holding the crayons in place is described as comprising pressure tab portion, it is contemplated that other retaining mechanisms may also be employed without departing from aspects of the present invention. For example, the crayons may be gripped by creating a gripping surface on the interior surface of each retaining/dispensing holder 130 by using, for example, textures such as grids, ribbing, or a sand paper like texture. Other possibilities may include adding stickiness to the surface of the interior surface of each retaining/dispensing holder 130, such as for example by employing a treatment like rubberizing the interior surface to increase friction, and the like.

Figure 9:
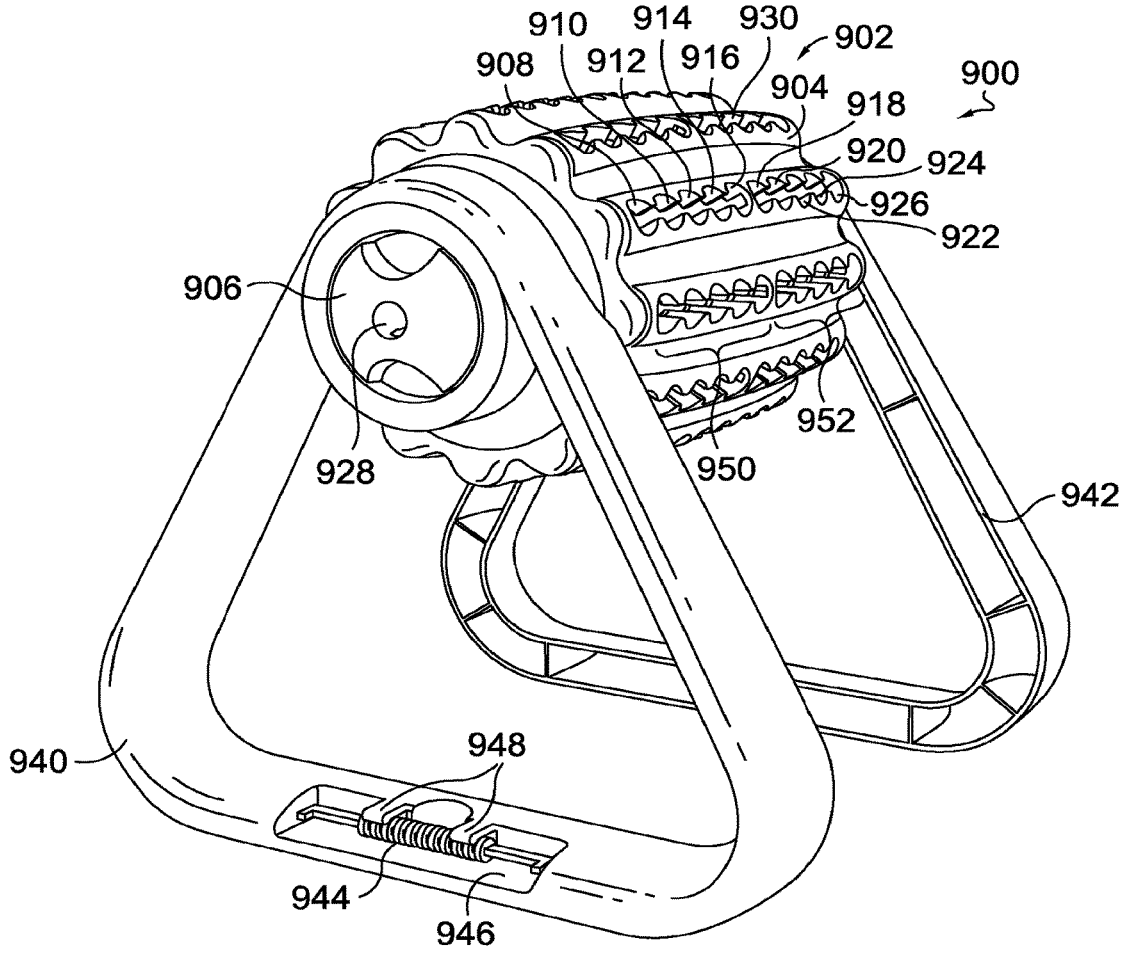
FIG. 9 depicts another exemplary unloaded crayon organizer and dispensing device, in accordance with aspects herein.

Alternatively, as shown in FIG. 9, the crayon storage and dispensing device in accordance with aspects herein comprise a different configuration for the guide channels, for example, as shown in device 900. In device 900, each guide channel 904 comprises a group of interconnected retaining/dispensing holders 930. In device 900, for example, each guide channel comprises a first group 950 having five interconnected retaining/dispensing holders (908, 910, 912, 914, and 916), and a second group 952 having another five interconnected retaining/dispensing holders (918, 920, 922, 924, and 926), as better seen in FIG. 10. Although, the particular configuration shown in FIGS. 9 and 10 comprises groups of five interconnected retaining/dispensing holders 930, it is contemplated that the groups may include as little as two interconnected retaining/dispensing holders 930, up to any desired amount, depending on the size (based on a maximum number of crayons that can be stored) of the device 900, without departing from aspects in accordance herein. Similar to device 100, the cylindrically shaped drum 902 is supported by a leg stand 940 and a leg stand 942 of device 900, and secured by cap(s) 906. The cap 906 may further be equipped with a crayon sharpener 928 and a cleaning tool 944. At least one of the leg stand 940 or the leg stand 942 may be provided with a housing 946 to store cleaning tool 944, which may be held in place by, for example, tab portions 948.

Figure 10:
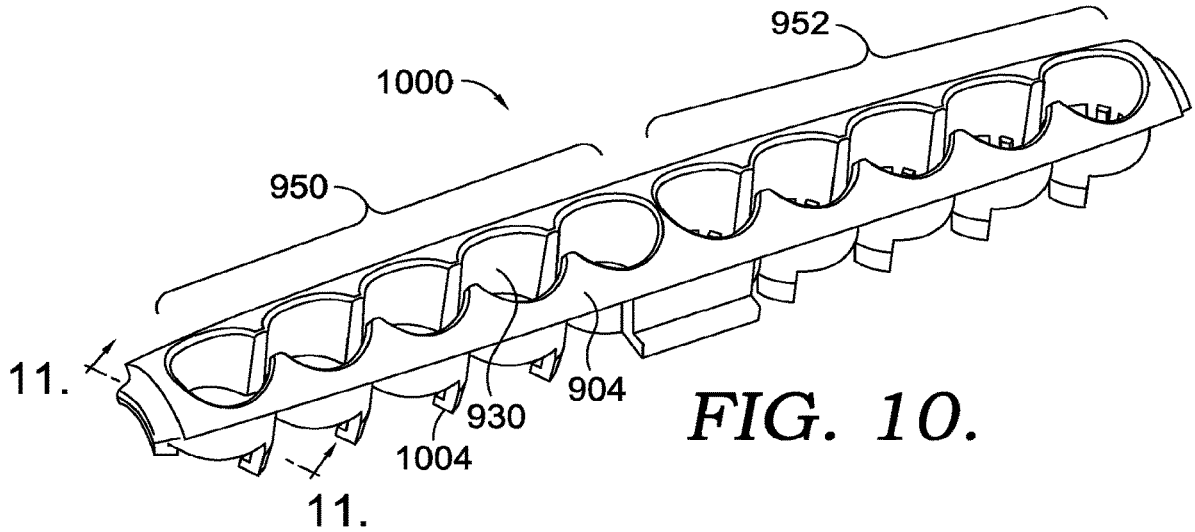
FIG. 10 depicts an exemplary guide channel used in the crayon organizer and dispensing device shown in FIG. 9, in accordance with aspects herein.

Moving on to FIG. 10, the guide channel 1000 may comprise two or more interconnected retaining/dispensing holders 930. Having the retaining/dispensing holders 930 be interconnected may be advantageous because rather than having to remove the entire guide channel 1000 for cleaning, as would be the case for guide channel 600 shown in FIG. 6, neighboring retaining/dispensing holders 930 may be cleaned by reaching into an adjacent retaining/dispensing holder 930, when two or more of the retaining/dispensing holders 930 are interconnected as would be the case for guide channel 1000 shown in FIG. 10.

Figure 11:
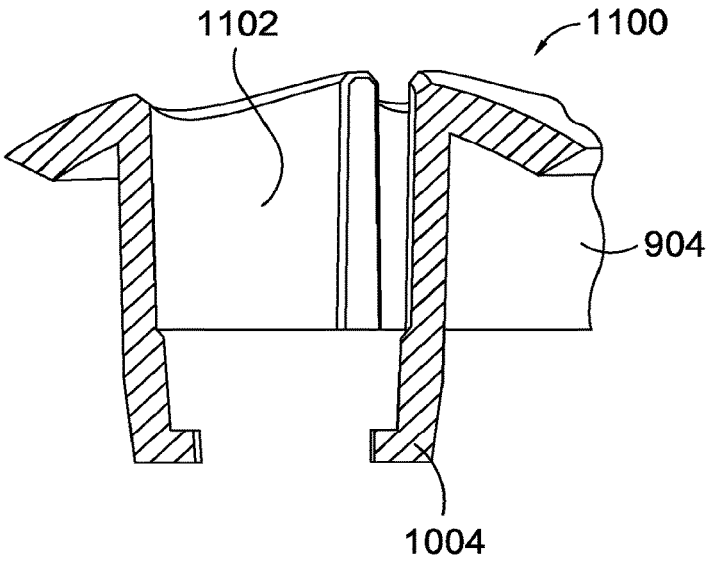
FIG. 11 depicts a cross-sectional view of the guide channel depicted in FIG. 10 taken along the line 10-10 in an unloaded state, in accordance with aspects herein.
Figure 12:
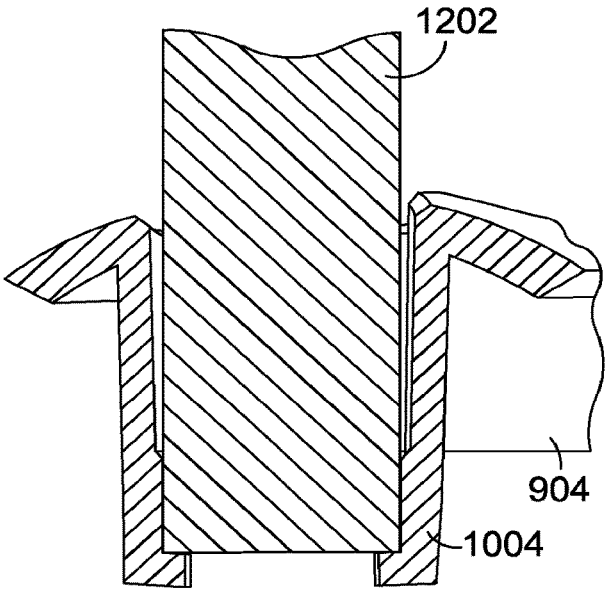
FIG. 12 depicts the cross-sectional view of the guide channel depicted in FIG. 11 in a loaded state.

Moving on to FIG. 11, a cross-sectional view 1100 taken along the line labeled as 11-11 in FIG. 10 of a retaining/dispensing holder 930 is shown. As shown in FIG. 11, the interior cavity 1102 of the retaining/dispensing holder 930 comprises two or more tab portions 1004 inside the interior cavity 1102 that are configured to retain a crayon 1202 in the interior cavity 1102 of the retaining/dispensing holder 930 until a user pulls the crayon 1202 out, as can be seen in the cross-sectional view 1200 in FIG. 12. In accordance with certain aspects herein, the tab portions 1004 are slightly angled inward, which provides some resistance. When crayon 1202 is pushed into the interior cavity 1102, the tab portions 1004 are pushed and flexed outwardly by the crayon's body that is within the interior cavity 1102. The resistance provided by the natural state (angled inward) of the two or more tab portions 1004 translates into a retaining force that is strong enough to allow the two or more tab portions 1004 to hold onto the crayon 1202, thereby defying gravity, even when the crayon 1202 were to face straight down, such as, for example, crayon 804 shown in FIG. 1, and while the crayons are subjected to rotation when loaded onto device 900. However, the retaining force provided by the natural state (angled inward) of the two or more tab portions 1004 is weak enough to allow a user to effortlessly remove each of the plurality of crayons 128 from the retaining/dispensing holders 930, as shown in FIG. 9.

Figure 13:
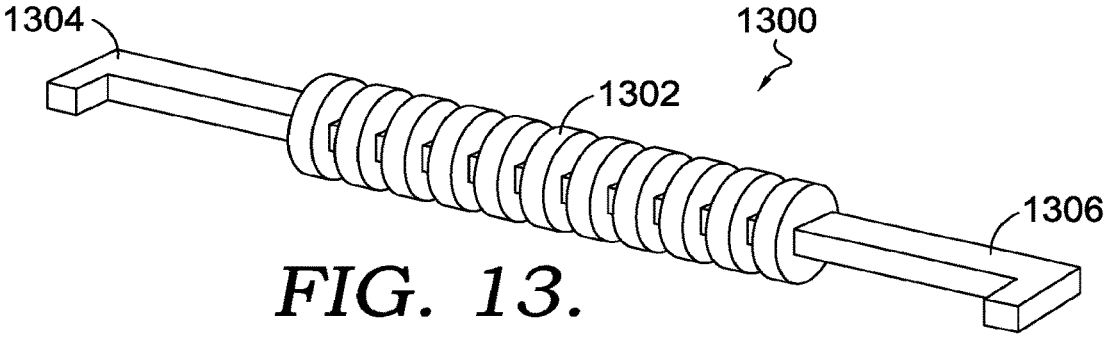
FIG. 13 depicts a cleaning tool that may be provided with the crayon organizer and dispensing device shown in FIG. 9, in accordance with aspects herein.

In further aspects in accordance with aspects herein, a cleaning tool 1300, may be provided as part of a kit, as shown in FIG. 9. As further shown in FIG. 13, the cleaning tool 1300 may comprise a grip portion 1302 and at least one cleaning tip 1304 extending from the grip portion 1302. Depending on the particular configuration of the guide channels 104/600/1000, the cleaning tip 1304 may comprise an angled end, as shown, to fit into a retaining/dispensing holder 930 and reach into and clean an adjacent retaining/dispensing holder 930 when two or more of the retaining/dispensing holders 930 are interconnected, as shown in FIG. 10. Alternatively, the cleaning tip 1304 of the cleaning tool 1300 may be comprised of a brush, a straight end, a needle end, and the like. As well, the cleaning tool 1300 may comprise a first type of cleaning tip 1304 extending from one end of the grip portion 1302 and a second type of cleaning tip 1306 extending from the other end of the grip portion 1302. Further, also in accordance with aspects herein, the cleaning tool 1300 may be provided with the same type of cleaning tip 1304/1306 extending from both sides of the grip portion 1302.

From the foregoing, it will be seen that this disclosure is one well adapted to attain all the ends and objects described and with other advantages that are obvious and/or are inherent to the structure.

It will be understood that certain features and subcombinations are of utility and may be employed without reference to other features and subcombinations. This is contemplated by and is within the scope of the claims.

Since many possible embodiments may be made of the disclosure without departing from the scope, it is to be understood that all matter described or shown in the accompanying drawings is to be interpreted as illustrative and not in a limiting sense.

What is claimed is:

1. A crayon storing and dispensing device comprising:

a first stand and a second stand configured to support a rotatable drum a first distance above a supporting surface of the rotatable drum, wherein the rotatable drum is supported by the first stand and the second stand through a pole, wherein the pole extends through a gear comprising a plurality of teeth, and wherein the plurality of teeth are configured to engage a stopping pin; and a plurality of guide channels distributed around a curved surface of the rotatable drum, each of the plurality of guide channels having a plurality of retaining/dispensing holders, wherein each retaining/dispensing holder in the plurality of retaining/dispensing holders is configured to hold and dispense a crayon.

2. The crayon storing and dispensing device of claim 1, wherein the plurality of retaining/dispensing holders form a plurality of concentric rows around the curved surface of the rotatable drum.

3. The crayon storing and dispensing device of claim 1, wherein the crayon is configured to extend orthogonal to a rotational axis of the rotatable drum.

4. The crayon storing and dispensing device of claim 1, wherein the curved surface of the rotatable drum is a threshold distance above the supporting surface.

5. The crayon storing and dispensing device of claim 4, wherein the threshold distance is greater than a length of the crayon.

6. The crayon storing and dispensing device of claim 1, further comprising a crayon sharpener.

7. The crayon storing and dispensing device of claim 1, wherein each of the retaining/dispensing holders comprises two or more tab portions.

8. The crayon storing and dispensing device of claim 1, wherein the rotatable drum is configured to rotate in at least a first direction.

9. The crayon storing and dispensing device of claim 8, wherein the rotatable drum is further configured to rotate in a second direction that is opposite to the first direction.

10. The crayon storing and dispensing device of claim 1, wherein at least two retaining/dispensing holders of the plurality of retaining/dispensing holders in each guide channel of the plurality of guide channels are interconnected.

11. A crayon storing and dispensing device kit comprising:

a crayon storing and dispensing device having:

a first stand and a second stand configured to support a rotatable drum a first distance above a supporting surface; and a plurality of removable guide channels, wherein each removable guide channel of the plurality of removable guide channels is fitted to a respective opening of a plurality of openings distributed around a curved surface of the rotatable drum, the each removable guide channel of the plurality of removable guide channels having a plurality of retaining/dispensing holders, wherein each retaining/dispensing holder in the plurality of retaining/dispensing holders is configured to hold and dispense a crayon; and a cleaning tool.

12. The crayon storing and dispensing device kit of claim 11, wherein the plurality of retaining/dispensing holders form a plurality of concentric rows around the curved surface of the rotatable drum.

13. The crayon storing and dispensing device kit of claim 11, wherein the crayon is configured to extend orthogonal to a rotational axis of the rotatable drum.

14. The crayon storing and dispensing device kit of claim 11, wherein the curved surface of the rotatable drum is supported a threshold distance above the supporting surface.

15. The crayon storing and dispensing device kit of claim 14, wherein the threshold distance is greater than a length of the crayon.

16. The crayon storing and dispensing device kit of claim 11, further comprising a crayon sharpener.

17. The crayon storing and dispensing device kit of claim 11, wherein each of the retaining/dispensing holders comprises two or more tab portions.

18. The crayon storing and dispensing device kit of claim 11, wherein the rotatable drum is configured to rotate in at least a first direction and/or a second direction that is opposite to the first direction.

19. A crayon storing and dispensing device comprising:

a central axis of rotation, wherein the central axis of rotation is parallel to a plurality of guide channels arranged around a curved surface of a cylindrical rotatable drum that is supported a threshold distance above a supporting surface by a first stand and a second stand, wherein the rotatable drum is supported by the first stand and the second stand through a pole, wherein the pole extends through a gear comprising a plurality of teeth, and wherein the plurality of teeth are configured to engage a stopping pin;

wherein the cylindrical rotatable drum comprises a first base and a second base, wherein a length of the cylindrical rotatable drum extends from the first base to the second base, wherein each of the guide channels in the plurality of guide channels comprises one or more retaining/dispensing holders configured to hold and dispense a crayon.

20. The crayon storing and dispensing device of claim 19, wherein the threshold distance is greater than a length of the crayon.

* * * * *